US006615761B2

(12) United States Patent
Wyman

(10) Patent No.: US 6,615,761 B2
(45) Date of Patent: Sep. 9, 2003

(54) SWIMMER TRANSPORT DEVICE

(75) Inventor: David Wyman, Castine, ME (US)

(73) Assignee: Stidd Systems Inc., Greenport, NY (US)

( * ) Notice: Subject to any disclaimer, the term of this patent is extended or adjusted under 35 U.S.C. 154(b) by 0 days.

(21) Appl. No.: 09/823,479

(22) Filed: Mar. 30, 2001

(65) Prior Publication Data

US 2001/0035120 A1 Nov. 1, 2001

Related U.S. Application Data

(60) Provisional application No. 60/195,384, filed on Apr. 7, 2000.

(51) Int. Cl.[7] ..... B63C 11/46
(52) U.S. Cl. ..... 114/315
(58) Field of Search ..... 114/312, 315, 114/330, 331, 332, 338, 244, 245; 440/6, 66, 70, 71, 72; 441/135

(56) References Cited

U.S. PATENT DOCUMENTS

| | | | | | |
|---|---|---|---|---|---|
| 2,377,442 | A | * | 6/1945 | Osterhoudt | 114/245 |
| 2,918,889 | A | * | 12/1959 | Rebikoff | 114/315 |
| 3,065,722 | A | * | 11/1962 | Green | 114/245 |
| 3,160,133 | A | * | 12/1964 | Walker | 114/245 |
| 3,466,798 | A | * | 9/1969 | Speers et al. | 446/162 |
| 3,650,234 | A | * | 3/1972 | Goudy | 114/315 |
| 3,757,721 | A | * | 9/1973 | Ohishi | 114/315 |
| 5,379,714 | A | | 1/1995 | Lewis et al. | |
| 5,399,111 | A | * | 3/1995 | Kobayashi et al. | 440/6 |
| 5,704,817 | A | | 1/1998 | Vaughn | |
| 5,782,664 | A | | 7/1998 | Casters | |
| D399,183 | S | * | 10/1998 | Ciamillo, II | D12/308 |
| RE36,093 | E | | 2/1999 | Wyman et al. | |
| 5,988,096 | A | | 11/1999 | Benesch et al. | |

FOREIGN PATENT DOCUMENTS

| | | | | |
|---|---|---|---|---|
| DE | 3513515 | * | 10/1986 | 114/315 |
| IT | 728592 | * | 12/1966 | 114/315 |

* cited by examiner

*Primary Examiner*—S. Joseph Morano
*Assistant Examiner*—Andrew Wright
(74) *Attorney, Agent, or Firm*—Schweitzer Cornman Gross & Bondell LLP

(57) ABSTRACT

A self-propelled underwater transport vehicle provides propulsion for one or more divers to allow submerged travel over extended distances. The vehicle has a cylindrical open hull supporting a deck upon which a diver is supported in a prone position. A blunt bow extends upwardly from the front of the hull, and develops a flow shadow in which the diver is positioned. A control yoke, operable by the diver, is connected to steering elements, which may include bow planes and a pivoting thruster. The cylindrical hull allows the vehicle to closely approach objects without contact therewith, while the flow shadow developed by the bow minimizes drag, despite the open structure of the vehicle.

13 Claims, 2 Drawing Sheets

10
12
14
16
18
20
22
24
26
28
32
46
48
50
54
56
78
4

SWIMMER TRANSPORT DEVICE

The present invention relates to a submersible, self-propelled transport device for scuba divers and the like. Priority of Provisional application 60/195,384 of Apr. 7, 2000 is claimed.

BACKGROUND OF THE INVENTION

Military, commercial and recreational pursuits all may require that undersea personnel travel substantial distances under water. Military operations require that military personnel approach an objective from the sea and reach the objective quickly, quietly and in good physical condition. Commercial endeavors often require the shuttling of personnel to and from an undersea work site, while recreational pursuits, such as wreck exploration, may require substantial travel from the surface to and from the exploration site. As swimmers equipped with self-contained underwater breathing (SCUBA) apparatus have a limited underwater duration, manual propulsion at a slow travel rate both depletes the available air supply, limiting the time that the diver can spend at his assigned duties, and also limits the range of travel. In addition, the physical exertion required for manual propulsion can leave the diver fatigued, low on air, and incapable of performing at an optimum level.

There have heretofore been developed propulsion devices which purport to assist in the transport of divers. For example, U.S. Pat. No. Re 36,093 to the present inventor and another discloses a submersible boat capable of both surface and submerged travel in which divers are situated in the interior. Such a construction is typically capable of delivering a plurality of personnel to a target location, but is not intended for use by one or two divers. Further, the device is relatively large and does not have the maneuverability of a small, individual use transport vehicle.

U.S. Pat. No. 5,379,714 to Lewis et al. discloses an aquatic vehicle for the underwater transport of swimmers and divers in which the user holds attachment grips located on opposed sides of the body.

In U.S. Pat. No. 5,988,096 of Nov. 23, 1999 to Benesch et al. a diver tow vehicle is provided, wherein the diver is behind a bullet-shaped shell. The device is not independently powered, however, but rather is towed by another vehicle. When the tow vehicle is disconnected from the propulsion vehicle, the tow vehicle stops and rises to the surface.

BRIEF DESCRIPTION OF THE INVENTION

It is a purpose of the present invention to provide a personal swimmer transport device to enable a diver to travel at increased speeds underwater over longer distances than has previously been possible with diver propulsion units.

A further purpose of the present invention is to provide a swimmer transport device which is capable of transporting cargo in addition to a diver.

A further purpose of the present invention is to provide a highly maneuverable, independently powered swimmer transport device.

Yet a further purpose of the present invention is to provide a swimmer transport device which is of compact design, and may be collapsible for storage.

In accordance with the foregoing and other objects and purposes, a swimmer transport device constructed in accordance with the present invention comprises a self-powered, open deck underwater travel watercraft providing motive power for supporting a diver oriented in a prone position above or upon the deck. The vehicle has a generally cylindrical open hull supporting the deck and having a blunt bow. The blunt bow forms a shroud extending above the deck whereby the diver, extending in a generally prone position on the craft deck, which is tethered to the watercraft within the flow shadow of the bow. A cargo area can be located below the forward deck portion. Propulsion, steering and depth control apparatus are provided, along with associated swimmer-operated controls therefor. A viewing port is provided in the bow to allow the swimmer to view the area ahead of the vehicle for navigation and reconnaissance purposes. Direction and depth gauges may also be provided.

Preferably, the buoyancy of the watercraft is trimmed to establish neutral buoyancy, thus facilitating control and operation of the device by the diver, and improving its maneuverability and travel efficiency. Depth control may be accomplished by a pair of bow planes coupled to a control yoke, while port/starboard steering may be accomplished by a rear pivoting electrical thruster, also controlled by the control yoke. The transport device may be constructed in forward and aft portions which are capable of being disconnected and slid together to allow the transport device to be stored in a collapsed configuration. The bow planes may be removable to allow the watercraft to be passed through hatches on conventional watercraft, such as submarines.

BRIEF DESCRIPTION OF THE DRAWINGS

A fuller understanding of the present invention will be accomplished upon review of the following detailed description of a preferred, but nonetheless illustrative embodiment thereof, when reviewed in connection with the annexed drawings, wherein.

DETAILED DESCRIPTION OF THE INVENTION

Figures 1, 2, 3:
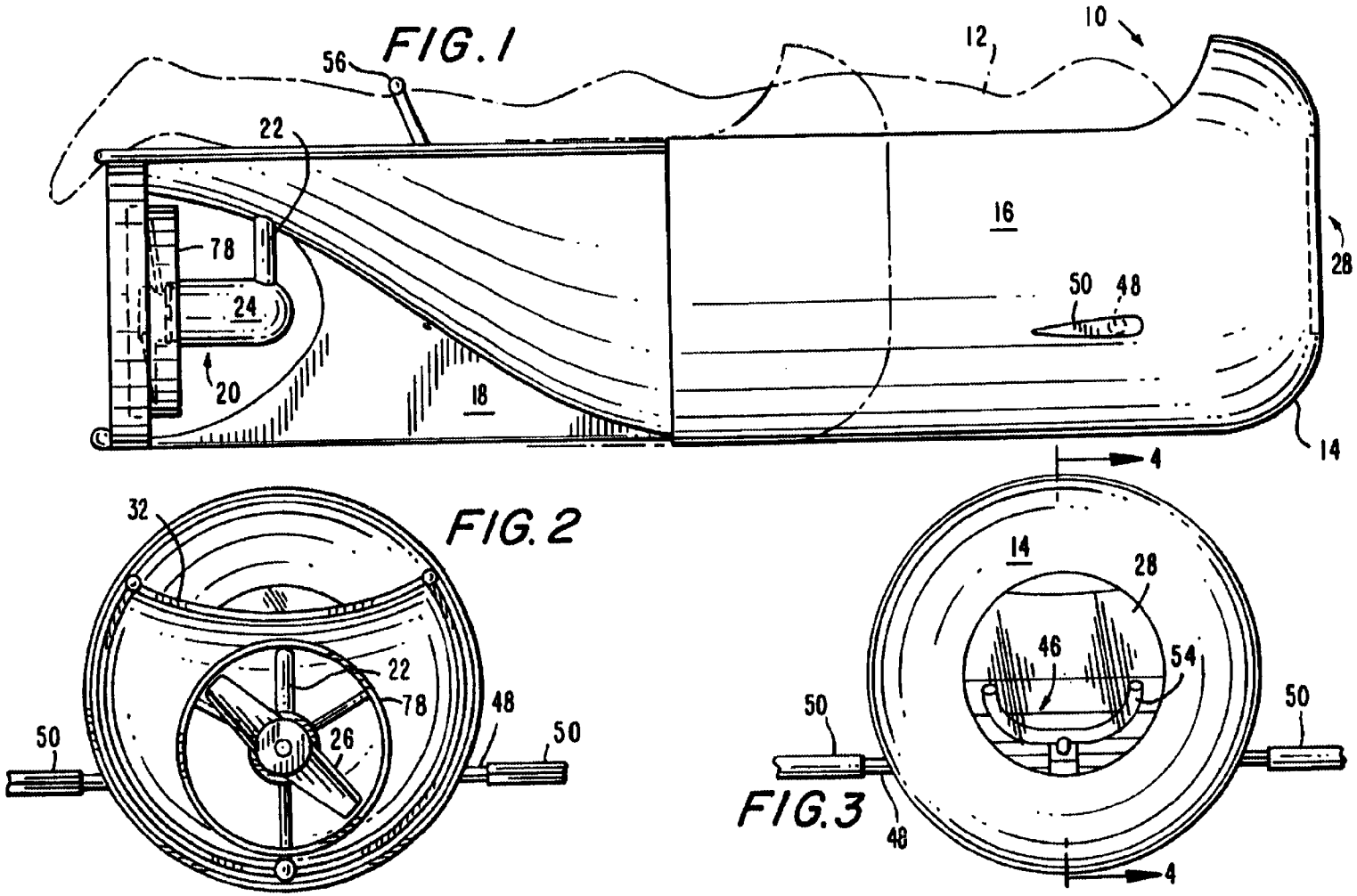
FIG. 1 is a side elevation view of a swimmer transport device constructed in accordance with the present invention.
FIG. 2 is a rear elevation view thereof.
FIG. 3 is a front elevation view thereof.

With initial reference to FIG. 1, the self-propelled swimmer transport device ("STD") 10 constructed in accordance with the present invention is adapted to transport a diver 12 lying in a prone position within the vehicle, the diver controlling the STD through operation of a control yoke and thruster control. Diver transport is preferably enabled by a T bar 56 connected to the forward portion of the hull by an adjustable length rope or lanyard. The T bar is held by the diver between and behind the legs allowing the forward motion of the vehicle to be coupled to the diver. The vehicle 10 is of an overall length of approximately seven feet, providing adequate support for a wide range of diver physiques. A second diver, lying atop and behind the first diver, can also be accommodated through the use of further transport enabling means, such as lateral handgrips located along the vehicle sides, in conjunction with a second T bar, which is held by the second diver's legs.

The vehicle includes a blunt bow 14, shaped to minimize underwater drag, the upper part of the bow projecting above the top of the side walls of the generally cylindrical hull 16. The curved or rounded bottom of the hull, as seen in FIGS.

2 and 3, permits the STD to closely approach the seabed or objects below the vehicle without colliding therewith, as Bernoulli attraction is minimized by the absence of a substantially flat bottom hull surface. The aft portion of the hull tapers upwardly, a skeg 18 extending downwardly from the tapered portion of the hull. A thruster 20, mounted upon a vertical pylon 22 extending through the hull behind the skeg 18, comprises an electrical motor drive 24, coupled to propeller 26. The pylon 22 is journaled in the hull, allowing the thruster 20 is rotatable about the vertical axis of the pylon for port/starboard steering purposes. A circular shroud 78 protects the diver from the propeller and also serves as a lateral stabilizer, preventing yaw of the vehicle. The tapered aft hull portion minimizes the drag of water flowing past the hull, and streamlines the flow past the thruster, improving thruster efficiency.

A transparent viewing port 28 is located in the bow, providing forward visibility for the diver, allowing the diver to remain fully prone and substantially within the flow shadow of the bow at all times during travel. A pair of bow planes 30, operable by the diver, allows for ascent and descent of the vehicle.

Figure 4:
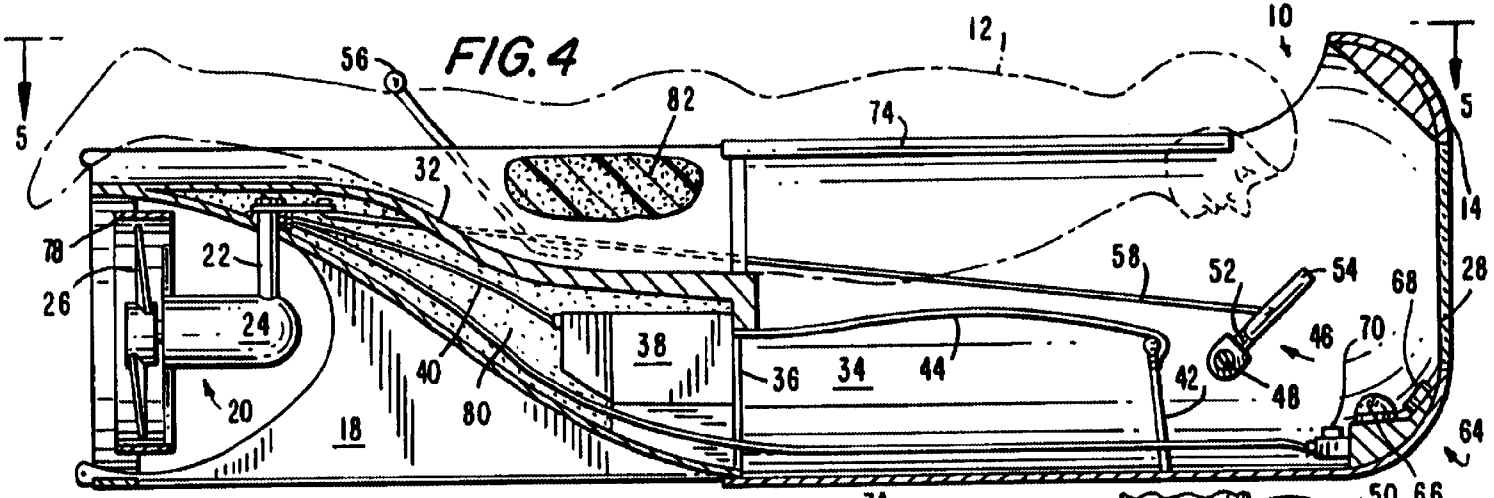
FIG. 4 is a sectional view taken along line 4—4 of FIG. 3.
Figure 5:
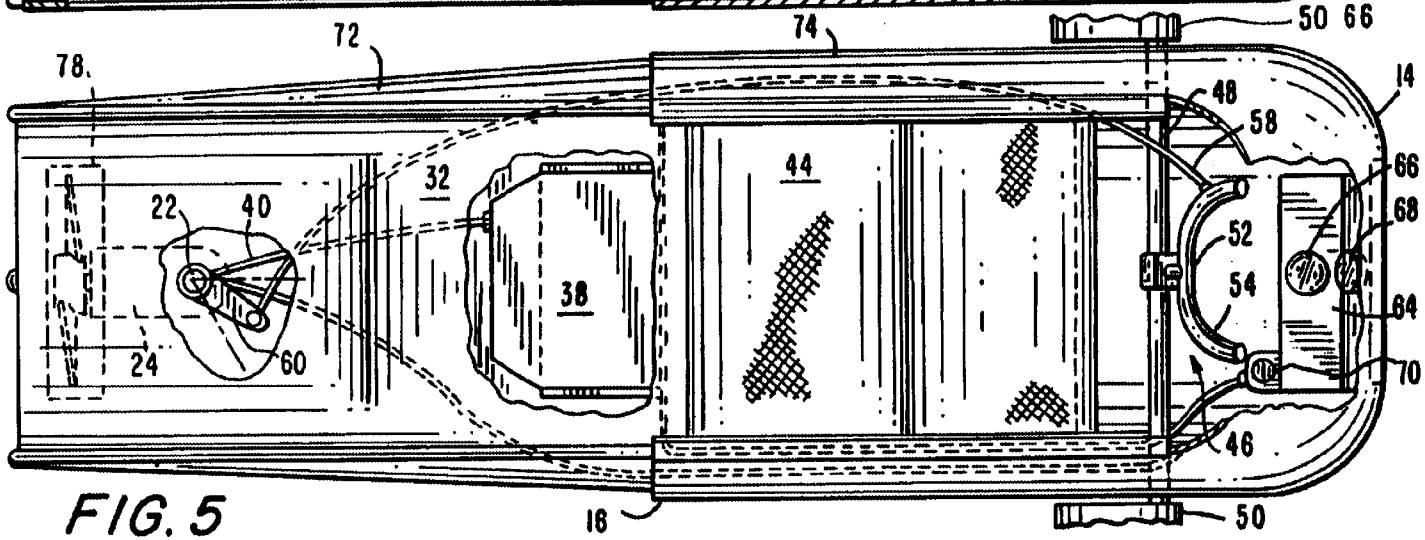
FIG. 5 is a top view taken along line 5—5 of FIG. 4.

With particular reference FIG. 4, a main deck 32, located between the opposed hull sidewalls and supported at its forward end by bulkhead 36, is provided within the hull 16 and provides a protected storage volume 80 within the hull. While the diver is of typically buoyantly neutral and thus does not need the deck for support, the deck can also assist in supporting a negative buoyancy diver in the prone position behind the bow. Preferably, a main portion of the deck is located in the aft portion of the vehicle, and is aligned and positioned such that the waist and legs of the diver can be supported thereby, while providing mobility to the diver's upper torso to allow the diver to grasp the control yoke 54 and operate other controls and devices as may be required. With the diver in the prone position, the upwardly extending bow 14 provides a shroud or shield function for the diver, diverting the water flow substantially around the diver and thus contributing to the creation of a low drag coefficient for the vehicle.

The main deck may be constructed of an appropriate rigid closed cell foam to allow the vehicle to attain neutral buoyancy. The foam is provided with an appropriate polymer coating or the like to afford rigidity and toughness to the deck. A fabric forward deck portion 44 may extend forward from the main deck 32, and forms a top for a storage compartment volume 34. The compartment 80 below the main deck 32 provides a protected mounting location for sealed battery pack 38, which provides electrical power for the thruster 20 and other electronic gear which may be provided. Appropriate cables, such as 40, interconnect the battery pack and the equipment to which it is connected. The fabric deck 44 may be removably affixed at its forward end to bulkhead 42, the fabric deck being released from the bulkhead to provide access to the compartment volume 34. The fabric deck 44 may also provide a measure of additional support for the diver.

A control assembly 46 is positioned at the bow, and is operable by the diver when in the prone position. The control assembly may include a first, transverse control arm 48, extending across the hull and journaled in the hull side walls, and which bears the bow planes 50. A second control arm 52 may be mounted to the first arm 48, extending in a generally perpendicular fashion therefrom, the end of the arm 52 bearing the control yoke 54 which is held by the diver and which is capable of a pivoting, lateral steering, motion. A control cable 58 extends from the control yoke 54 to a push arm 60 mounted to the upper end of motor drive pylon 22 within the hull, whereby port and starboard steering/pivoting action of the control yoke causes an appropriate pivoting action of the motor drive 24, effecting port /starboard steering. In a similar manner, a fore and aft pivoting motion of the control yoke 54 causes rotation of first control arm 48 about its longitudinal axis, effecting operation of the bow planes 50, and providing for ascent and descent control of the vehicle. The control yoke 54 thus provides full directional control.

Also mounted at the bow of the vehicle is an instrument module 64 which is preferably located at the bottom of the bow such that it can be observed by the diver without raising his head. The module may include a compass 66 and depth gauge 68. It may also include a switch 70 for the thruster 20. The switch 70 may be of the simple "on/off" variety, or may include proportional control circuitry to allow varying of the speed of the thruster motor as well as for a reverse function as may be appropriate.

Because the STD has significant military uses, it is advantageous that it be of a construction which permits it to be easily deployed from military vessels, such as submarines. Accordingly, the vehicle may be constructed in fore and aft sections, as shown in the Figures. In particular, the aft portion 72, which may include the tapering portion of the hull and terminates just forward of the bulkhead 36, is of a slightly smaller diameter than that of the forward portion 74. The forward and aft portions may be locked together in the extended and assembled position by the use of a series of locking pins or the like. The connection between the forward and aft sections may be intentionally formed with a gap or spacing between portions of the adjacent sections to allow for rapid drainage of the hull when the vehicle is lifted from the water. With the pins removed, the aft portion 72 can be slid forward within the hollow forward hull portion, substantially collapsing the length of the vehicle. The aft portion may be slid forward until the forward end of the hull portion is in contact with the forward bulkhead 42. The fabric deck may be folded back for clearance purposes.

The hull may be preferably constructed from welded marine grade aluminum, the viewing port 28 being constructed of an appropriate plastic. With an overall deployed length of approximately 84 inches, and a hull diameter of 24 inches, the STD can be deployed through standard military submarine hatches. When collapsed, the overall length is approximately 50 inches, providing a compact unit. The batteries of battery pack 38 are preferably of a silver-zinc composition, providing high output. To establish and trim the buoyancy of the vehicle to neutral, foam elements 82 may be installed on the inside hull sides as required. Approximately 3 cubic feet of volume in the forward storage space 34 is provided.

The present invention's structure of a neutral buoyancy watercraft with a cylindrical hull having a bow shroud for a prone diver, coupled with a rear thruster shroud and tapered aft hull section, yields a swimmer transport device having substantially less drag and improved stability, allowing the vehicle to maintain depths and tracking with minimal deviation and with minimal effort required to control the watercraft.

I claim:

1. A neutrally buoyant underwater swimmer transport vehicle, comprising:

a generally cylindrical open hull;

fixed neutral buoyancy means formed of a rigid material to closely equal the weight of water displaced by the whole vehicle;

a deck mounted in the hull;

means for enabling a diver to be transported by the vehicle in a prone position over the deck;

a blunt bow at a forward end of the hull, the bow extending upwardly above the deck and forming a forward shroud for the diver;

a pivotable pylon steering means mounted to the hull; and a thruster mounted to the pylon.

2. A neutrally buoyant underwater swimmer transport vehicle, comprising:

a generally cylindrical open hull;

fixed neutral buoyancy means formed of a rigid material to closely equal the weight of water displaced by the whole vehicle;

a deck mounted in the hull;

means for enabling a diver to be transported by the vehicle in a prone position over the deck;

a blunt bow at a forward end of the hull, the bow extending upwardly above the deck and forming a forward shroud for the diver;

steering means and depth control means mounted to the hull, the steering and depth control means comprising a control yoke pivotable about two independent pivot axes; and a thruster mounted to the hull.

3. A neutrally buoyant underwater swimmer transport vehicle, comprising:

a generally cylindrical open hull;

fixed neutral buoyancy means formed of a rigid material to closely equal the weight of water displaced by the whole vehicle;

a deck mounted in the hull;

means for enabling a diver to be transported by the vehicle in a prone position over the deck;

a blunt bow at a forward end of the hull, the bow extending upwardly above the deck and forming a forward shroud for the diver; and a thruster mounted to the hull, the thruster comprising an electric motor coupled to a battery source, a propeller mounted to a shaft of the motor and a peripheral shroud surrounding the propeller.

4. A neutrally buoyant underwater swimmer transport vehicle, comprising:

a generally cylindrical open hull having separable forward cylindrical and tapered aft portions, the aft portion supporting a skeg;

drainage means located at an intersection between the forward and aft portions;

fixed neutral buoyancy means formed of a rigid material to closely equal the weight of water displaced by the whole vehicle;

a deck mounted in the hull;

means for enabling a diver to be transported by the vehicle in a prone position over the deck;

a blunt bow at a forward end of the hull, the bow extending upwardly above the deck and forming a forward shroud for the diver; and a thruster mounted to the hull.

5. The transport vehicle of claim 4, wherein the forward hull portion has an inner diameter greater than an outer diameter of the rear hull portion to allow the rear hull portion to collapse within the forward hull portion for storage.

6. A neutrally buoyant underwater swimmer transport vehicle, comprising:

a generally cylindrical open hull having forward cylindrical and tapered aft portions, the aft portion supporting a skeg;

drainage means located at an intersection between the forward and aft portions;

fixed neutral buoyancy means formed of a rigid material to closely equal the weight of water displaced by the whole vehicle;

a main deck mounted in the hull and located in the aft portion of the hull;

means for enabling a diver to be transported by the vehicle in a prone position over the deck;

a blunt bow at a forward end of the hull, the bow extending upwardly above the deck and forming a forward shroud for the diver;

a thruster mounted to the hull; and an electrical power source located in the aft portion of the hull below the deck.

7. A neutrally buoyant underwater swimmer transport vehicle, comprising:

a generally cylindrical open hull having forward cylindrical and tapered aft portions, the aft portion supporting a skeg;

drainage means located at an intersection between the forward and aft portions;

fixed neutral buoyancy means formed of a rigid material to closely equal the weight of water displaced by the whole vehicle;

a deck mounted in the hull comprising a main deck located in the aft portion of the hull and a second deck portion located in the forward portion of the hull;

means for enabling a diver to be transported by the vehicle in a prone position over the deck;

a blunt bow at a forward end of the hull, the bow extending upwardly above the deck and forming a forward shroud for the diver; and a thruster mounted to the hull.

8. The transport vehicle of claim 7, wherein the main deck is supported within the aft portion of the hull by a bulkhead in the aft portion, the second deck portion being affixed to and extending forwardly from the bulkhead.

9. The transport vehicle of claim 7, wherein the second deck portion is constructed of fabric.

10. The transport vehicle of claim 3 or 4, further comprising steering means mounted to the hull.

11. The transport vehicle of claim 1, 2, 3, 4, 6 or 7, wherein the enabling means comprises a T-bar tethered to the hull.

12. The transport vehicle of claim 1, 2, 3, 4, 6 or 7, wherein the enabling means comprises the deck.

13. The transport vehicle of claim 1, 2, 3, 4, 6 or 7, wherein the deck forms at least a portion of the buoyancy means.

* * * * *